US007836518B2

(12) United States Patent
Bloom et al.

(10) Patent No.: US 7,836,518 B2
(45) Date of Patent: Nov. 23, 2010

(54) PROTECTIVE BIB OR APRON

(76) Inventors: David Richard Bloom, 166 Leavesden Road, Watford, Herts, WD24 5DJ (GB); Claudine Nicola Bloom, 166 Leavesden Road, Watford, Herts, WD24 5DJ (GB); Jayseelan Nadasen Padayachy, 166 Leavesden Road, Watford, Herts, WD24 5DJ (GB)

( * ) Notice: Subject to any disclaimer, the term of this patent is extended or adjusted under 35 U.S.C. 154(b) by 0 days.

(21) Appl. No.: 12/625,307

(22) Filed: Nov. 24, 2009

(65) Prior Publication Data

US 2010/0132088 A1 Jun. 3, 2010

Related U.S. Application Data

(63) Continuation of application No. 11/494,789, filed on Jul. 27, 2006, now abandoned, which is a continuation-in-part of application No. PCT/GB2005/000301, filed on Jan. 28, 2005.

(51) Int. Cl.
*A41D 13/04* (2006.01)

(52) U.S. Cl. ..... 2/50; 2/48

(58) Field of Classification Search ..... 2/48, 2/50, 49.1–49.5, 46, 51, 52, 135, 136, 141.2, 2/143, 141.1, 60, 468, 129, 133, 134, 131, 2/132, 92, 88; D2/860–864, 602, 603, 604
See application file for complete search history.

(56) References Cited

U.S. PATENT DOCUMENTS

| | | | | | |
|---|---|---|---|---|---|
| 60,488 | A | * | 12/1866 | Denison et al. | 2/136 |
| D6,988 | S | * | 11/1873 | Ellison | D2/603 |
| 313,547 | A | * | 3/1885 | Squires | 2/129 |
| D18,983 | S | * | 4/1889 | House | D2/602 |
| D26,313 | S | * | 11/1896 | Rosenthal | D2/603 |
| 1,029,891 | A | * | 6/1912 | Rice | 2/134 |
| 1,506,332 | A | * | 8/1924 | Bloom | 2/48 |
| 1,660,124 | A | * | 2/1928 | Grom | 2/50 |
| 2,114,922 | A | * | 4/1938 | Glasmann | 2/48 |
| D110,910 | S | * | 8/1938 | Roth | D2/603 |
| D113,450 | S | * | 2/1939 | Breuss | D2/603 |
| 2,174,694 | A | * | 10/1939 | Elson | 2/49.2 |
| D118,802 | S | * | 1/1940 | Breuss | D2/603 |
| 2,282,183 | A | * | 5/1942 | Harris | 2/50 |
| 2,364,568 | A | * | 12/1944 | Tiscornia | 2/50 |
| 2,523,565 | A | * | 9/1950 | Gardner | 2/49.1 |
| 2,620,475 | A | * | 12/1952 | Legg et al. | 2/50 |
| D220,153 | S | * | 3/1971 | Bush | D2/861 |
| 3,654,629 | A | * | 4/1972 | Crisman et al. | 2/49.1 |
| 3,747,122 | A | * | 7/1973 | Goldberg | 2/48 |

(Continued)

FOREIGN PATENT DOCUMENTS

| | | | |
|---|---|---|---|
| FR | 2438457 | * | 5/1980 |

(Continued)

*Primary Examiner*—Amy B Vanatta
(74) *Attorney, Agent, or Firm*—Knobbe Martens Olson & Bear LLP

(57) ABSTRACT

An apron for use by dentists and the like is provided with a main body portion and a collar portion for securing the apron to the wearer in which the collar portion is adjustably securable at any position within a predetermined range such that it forms a close fit around the wearer wherein the collar and body portions comprise an absorbent side and a substantially waterproof.

14 Claims, 6 Drawing Sheets

U.S. PATENT DOCUMENTS

| | | | | | |
|---|---|---|---|---|---|
| 3,798,674 | A | * | 3/1974 | Daniel | 2/50 |
| 3,945,048 | A | * | 3/1976 | Shearer | 2/48 |
| 4,416,025 | A | * | 11/1983 | Moret et al. | 2/49.3 |
| 4,458,364 | A | * | 7/1984 | Fenninger et al. | 2/50 |
| D290,545 | S | * | 6/1987 | Montalvo | D2/602 |
| 4,706,303 | A | * | 11/1987 | Van Gompel et al. | 2/49.2 |
| 5,572,740 | A | * | 11/1996 | Geniesse | 2/46 |
| 5,953,753 | A | * | 9/1999 | Perez | 2/50 |
| 6,479,727 | B1 | * | 11/2002 | Roe | 604/361 |
| 2003/0088902 | A1 | * | 5/2003 | Levy | 2/50 |

FOREIGN PATENT DOCUMENTS

| | | | |
|---|---|---|---|
| FR | 2827135 | * | 7/2001 |
| GB | 438035 | * | 11/1935 |
| GB | 456037 | * | 11/1936 |
| GB | 2364885 | * | 2/2002 |
| GB | 2405572 | * | 3/2005 |
| WO | PCT/GB2005/000301 | * | 1/2004 |

* cited by examiner

PROTECTIVE BIB OR APRON

CROSS-REFERENCE TO RELATED APPLICATIONS

This application is a continuation of U.S. patent application Ser. No. 11/494,789, filed on Jul. 27, 2006, which is continuation-in-part of PCT application Serial No. PCT/GB2005/000301, filed Jan. 28, 2005, designating the US and published in English on Aug. 25, 2005 as WO 2005/072541, and claiming priority to Great Britain patent application GB 0401854.5, filed on Jan. 28, 2004, the entireties of all of which are incorporated herein by reference and made part of the present disclosure.

FIELD OF THE INVENTION

This invention relates to a protective apron or bib of the type which may be used for a dental patient.

BACKGROUND OF THE INVENTION

Basic bib or aprons that are fastened around a patient's neck during dental or other procedures in order to protect the patient during treatment are already known. A common form of dentist's apron comprises a body portion covering the chest area of the patient and a collar portion attached to the body portion to secure the apron to the patient. The collar comprises two straps that extend beyond the main body portion of the apron to allow the collar to be adjustable so as to accommodate patients with a variety of neck sizes. Often, this is accomplished by forming a series of slots in one of the straps and by narrowing the tongue portion of the other strap so as to allow the tongue portion to be inserted in to the slot. The narrowed tongue portion is enlarged at the end so that the apron can be securely attached around the patient's neck.

A problem with this type of apron is that the patient is only partially protected by the apron since it only covers the chest area, and secondly that the collar is not really fully adjustable since only a predetermined number of slots can be provided in the strap of the collar. The situation then arises that the collar is either too loose, allowing fluid etc. to pass between the collar and the neck of the wearer, or that the collar is too tight, and the patient feels uncomfortably restricted by the collar of the apron. A further problem with this type of apron is that it is difficult to undo easily and quickly, which may be required in an emergency.

A further problem with conventional aprons is that the collar portions do not have sufficient absorbency for modern dental treatments. Such treatments are now more complex than ever before. Such treatments can take anything from 1 hour to 9 hours, compared with the relatively short procedures that were performed in the past. The increase in complexity of procedures is partly due to the improvement of the standard of dental care over the years, but increasingly is because more and more patients are now undergoing complex cosmetic dental procedures. Recent surveys have shown that more than 92% of dentists in the UK now offer cosmetic dentistry in their practice, and that over 90% of dentists in the UK agreed or strongly agreed that they had noticed an increased demand for cosmetic dentistry in the last five years. Such procedures are commonly performed by private dental clinics, and as such, patients expect a much higher level of care and comfort during and after the dental procedures.

Therefore, dental treatment is increasingly based on the patient's desire for cosmetic dental improvement procedures rather than the traditional visits by patients to their dentist for treatments simply to alleviate pain.

Private clients therefore expect to be pampered and are more and more seeking a more comfortable experience whilst lying in the dental chair to make their visits more pleasant.

SUMMARY OF THE INVENTION

The inventors have appreciated that for more lengthy cosmetic dental procedures, currently available aprons are uncomfortable when they become saturated with liquid. Often these aprons are thin and cover just the chest area. Some water is absorbed here, but due to the fact that patients are horizontal, most of the spilt water spray runs from the corner of the mouth down into the nape of the neck.

When appointments were short and were not cosmetic based procedures, such basic aprons were adequate in protecting patients. Now, however, with increased competition in the market for treating private patients who desire a higher level of care and comfort, there is a need for an apron with a body and collar portions that effectively prevent excess water spray from rolling down the patient's neck and soaking the patients back during extended treatments.

Accordingly, preferred embodiments of the invention seek to provide an improved apron that reduces the wetness of a patient's neck and back during and after treatment.

In accordance with the present invention there is provided a protective apron comprising a main body portion and a collar portion for securing the apron to the wearer in which the collar portion is adjustably securable at any position within a predetermined range such that it forms a close fit around the wearer wherein the collar and body portions comprise an absorbent side and a substantially waterproof side.

In one embodiment of the present invention, the neck size of the apron is adjustable so that the collar portion of the apron can be tightly but comfortably wrapped around the patient's neck and secured in position using hook and loop material.

In a further embodiment, the collar portion of the apron is secured in position using self-adhesive materials. This embodiment has the advantage that during the manufacture process of the apron, a separate stitching process is not needed, and self-adhesive strips can simply be applied to the collar portion of the apron to secure it in position.

Both these embodiments prevent any fluid that is accidentally spilt onto the patient from running down the collar or on to the patient.

A further advantage of using hook and loop material or self adhesive materials to attach the apron to the patient is that the patient may be quickly and easily released from the apron.

Furthermore it is common practice for dentists to use a water-cooling spray during surgery or an oral spray to clean out a patient's mouth after surgery. It is therefore important that if the apron is to be used as a dentist's apron, that it is preferably made out of a highly absorbent material such as towelling, or non-woven materials such as viscose and polyester fibres in a single sheet or in a laminated construction.

In this way, any spilt spray or other spillage is immediately absorbed into the apron before it can flow from the apron onto the patient's clothes, if the body and collar portions of the apron do not entirely cover the patient. In addition, during treatment it is often the case that small spillages regularly occur around the patient's mouth. It is foreseen in such circumstances that the dentist's assistant or even the patient could use a lower portion of the apron to absorb the spillage before it naturally runs onto the patient's apron, if the apron were to be made out of a highly absorbent material. In this embodiment, the use of a towelling material would furthermore be advantageous because it is a highly durable material, and so would allow the dentist to launder the apron frequently to maintain the highest standards of cleanliness.

In a further embodiment, the apron can be manufactured from viscose and polyester fibres, other non-woven materials or other materials with similar absorbing properties either in a single sheet or in a laminated construction. The advantage of using non-woven materials is not only its capacity to absorb large quantities of liquid, but also because the use of such materials would allow a cost effective apron to be produced using a high-speed manufacture process. These materials are relatively inexpensive, and an apron made out of such materials would be simple to manufacture since the apron can be formed out of a single sheet of the material.

Using this process, the body and collar portions can be flat packed and distributed quickly and efficiently. Also this embodiment has the advantage that the apron is disposable as clinical waste. In this way a dentist can easily maintain hygiene and cleanliness standards.

BRIEF DESCRIPTION OF THE DRAWINGS

An embodiment of the invention will now be described in detail by way of reference to the accompanying drawings, in which.

DETAILED DESCRIPTION OF THE PREFERRED EMBODIMENTS

Figure 1:
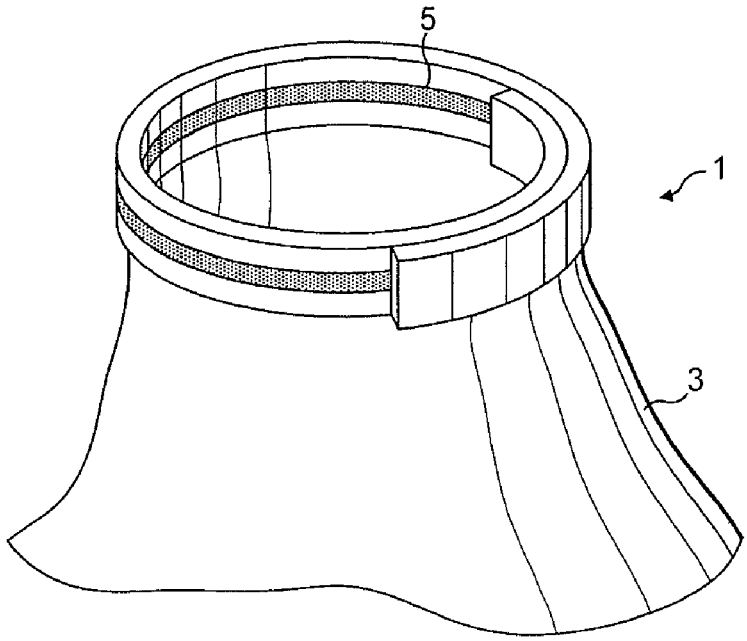
FIG. 1 is a perspective view of the apron arranged as it would be when fitted on a wearer.
Figure 2:
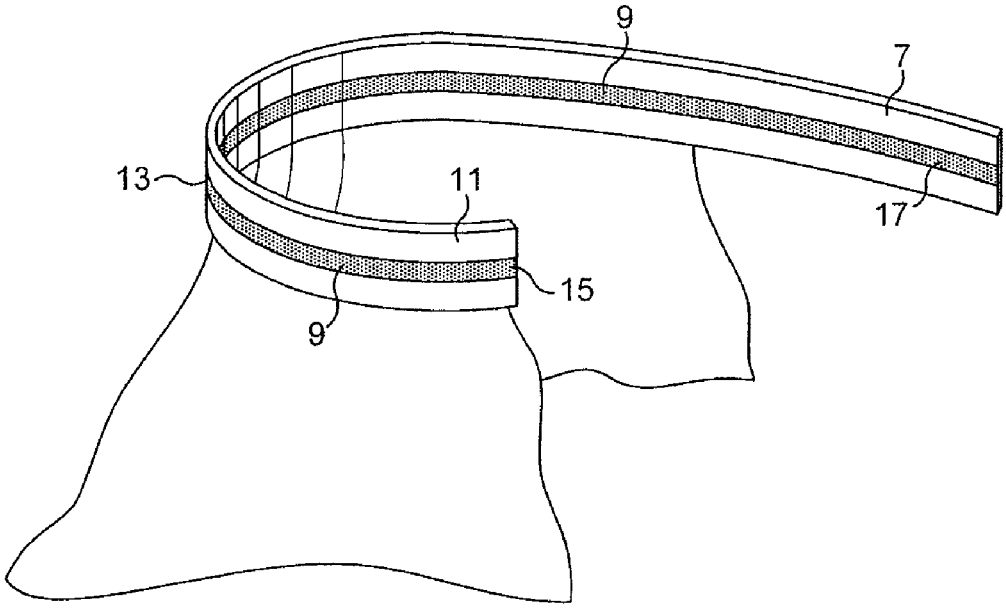
FIG. 2 is a perspective view of the apron prior to mounting on the wearer.

Referring to the drawings, there is shown in FIG. 1 an apron 1 with a body portion 3 and attached to it a collar portion 5. The collar portion has a strap with one or two of its ends 7 protruding from respective sides of the main body section 3. FIG. 2 shows the case where the strap only extends on one side from the body section.

At each end of the strap 7, 11 there is fixedly attached opposing portions of hook and loop fixing material 9 e.g. Velcro®. This hook and loop material extends at least partially along one end of the strap. For example it could extend the full length of the extending end of the strap, as shown in FIG. 2, although in practice this is only likely to be necessary in embodiments where the portion of the strap attached to the apron extends the whole way around a wearer's neck. In most embodiments this portion will only extend partially around a wearer's neck and therefore hook and loop material will not be required all the way along the extending end 7 of FIG. 2. When the extended tongue section 7 of the collar is wrapped around the neck of the patient over the top of the other section of the collar 11, the two pieces of hook and loop material oppose one another and by securely pressing the tongue section on to the collar section, the apron is securely but releasably fixed to the wearer.

It will be seen by those skilled in the art that there are three possible combinations relating to the relative lengths of the two pieces of hook and loop material attached to the extended tongue section 7 and to the other section of the collar 11.

Firstly, there is the case where the lengths of the two pieces of hook and loop material is equal. Assuming that the lengths of the hook and loop material extend both to the end 15 of the collar section 11, and to the end 17 of the extended end section 7, increasing the length of hook and loop material on both parts of the collar section will mean that the minimum neck size that the apron is able to accommodate will be reduced. However, there will be no increase in the maximum neck size that the apron will be able to accommodate, because this is determined by the length of collar material between points 15 and 17.

Secondly there is the case when the length of hook or loop material on the collar section 11 is larger than the length of hook or loop material placed at 17 on the extending end 7. The length of hook or loop material required on the collar section 11 is only as long as the range of neck sizes that the collar portion is required to accommodate. When the end 17 is approximately aligned with point 15 on the collar section 11, this corresponds to the maximum neck size that the apron is able to accommodate. Correspondingly when the end 17 is approximately aligned with point 13 on the collar section 11, this corresponds to the minimum neck size the apron is able to accommodate.

The final case is when the length of hook or loop material placed at position 17 of the extending end 7 is greater than that placed at position 15 of the collar section 11. With this arrangement increasing the length of hook or loop material at position 17 reduces the minimum neck size accommodated by the apron, but for smaller neck sizes it will be noted that there will be a portion of the end 17 of the extending end 7 that will not be attached to a corresponding piece of hook and loop material on the collar section 11. Indeed a small section of end 17 of the extending end section 7 not fixed to the collar section 11 may even be desirable to facilitate the removal of the apron but it should be noted that a very long end 17 that is not affixed to the collar is awkward and undesirable.

Furthermore it should be noted that the hook and loop material does not necessarily have to be positioned at the end 15 of the collar section 11, or at the end 17 of the extending end section 7. The hook and loop material could be advantageously positioned part way along for some embodiments of the present invention.

In a further embodiment, the hook and loop material fixing means used in the previous embodiment can be replaced by self-adhesive materials. This embodiment has the advantage that a separate stitching process is not required to attach the self-adhesive materials.

In one embodiment the apron is made out of a towelling material. This has the advantage that it is highly absorbent and so immediately absorbs any spillage. Secondly, the towelling material also has a soft, deformable texture and so an exact fit of the collar portion of the apron is not necessary; the soft, deformable texture of the towelling material accommodates any small gap in the collar.

In a further embodiment it is envisaged that the apron could be made out of a disposable material such as paper or absorbent paper. Such an apron could then be used in situations where it is desirable to discard the apron after a single use.

In yet a further embodiment it is envisaged that the apron could be made out of a plastics material. This could be advantageous if a prolonged procedure is anticipated, so that the spilled material would run off the apron instead of being absorbed into it. In such an embodiment it would be advantageous to have an enlarged body section that extends completely over the patient, so that any spilled material does not run onto the patient, but onto the floor beneath.

Figure 3:
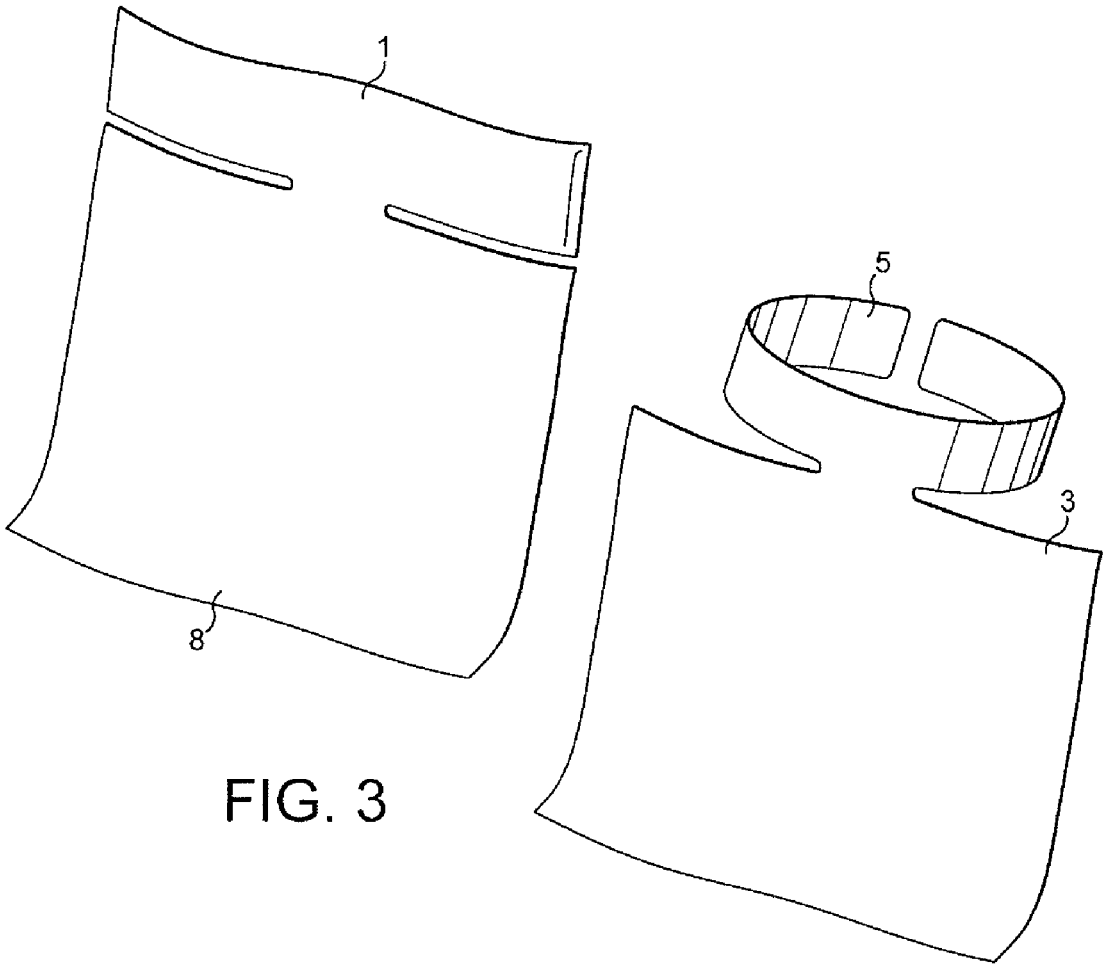
FIG. 3 is a perspective view of the apron made out of a single sheet of material

A further embodiment is shown in FIG. 3. In this embodiment, the collar 5 and body portions 3 are formed from a single piece of material. However, the construction of the neck portion in this embodiment is similar to previous embodiments, and uses hook and loop material or other adhesive or self-adhesive material to secure the collar to the neck of the patient during the procedure. The single piece construction of the collar and body portions in this embodiment simplifies the manufacturing process since no additional fixing means is needed to attach the collar to the body of the apron. Preferably, the material for the apron is formed from a material or materials with an absorbent side 8 to absorb and lock away any spillages occurring during treatment and a waterproof side to prevent the absorbed moisture from leaking through the absorbing material on to the patient's clothes or skin beneath (not shown). The absorbent material could be made out of non-woven materials such as viscose and polyester in a single sheet or in a laminated configuration. Alternatively, the laminate or single sheet material could be formed using hydro-entanglement or thermal bonding.

Figure 4:
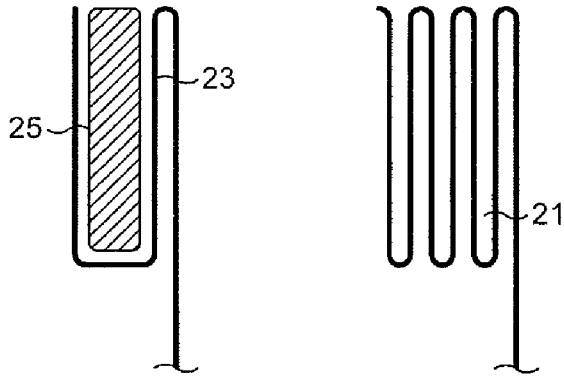
FIG. 4 is a sectional view through the collar portion showing the arrangement of the absorbing material in two different embodiments.

FIG. 4 shows a further embodiment showing sections through the collar portion 1 of the apron. The moisture absorbing material in the collar portion can either be formed by making a series of pleats 21 in the collar portion of the apron, or by using one or more pleats 23 with additional moisture absorbing material 25 in between the pleat or pleats. The pleats 21, 23 can be held in position by using heat sensitive self-adhesive materials applied on top of the absorbing layer, by using adhesive, stitching, or other fixing means (not shown). By forming a series of pleats any moisture that has rolled down the patient's neck is prevented from travelling down the back because it is absorbed by the absorbing material located on the surface of the apron material. Using the pleat structure has several advantages in that it simplifies construction of the apron because it requires only the use of a single sheet of material, and also allows more absorbing material to be concentrated in the neck area than would be present if just a single layer of material were used.

The pleat structure also has the advantage that it has a natural flexibility to adapt to the shape of the patient's neck so that there are no gaps between the patient's neck and the collar.

Obviously, any number of pleats can be used to form the collar portion.

FIG. 4 also shows a further embodiment in which one or more pleats 23 are formed using the collar material which acts as a holder for additional absorbing material 25. This structure can be held in position using adhesive, self-adhesive materials or stitching or any other fixing means (not shown).

Figure 5:
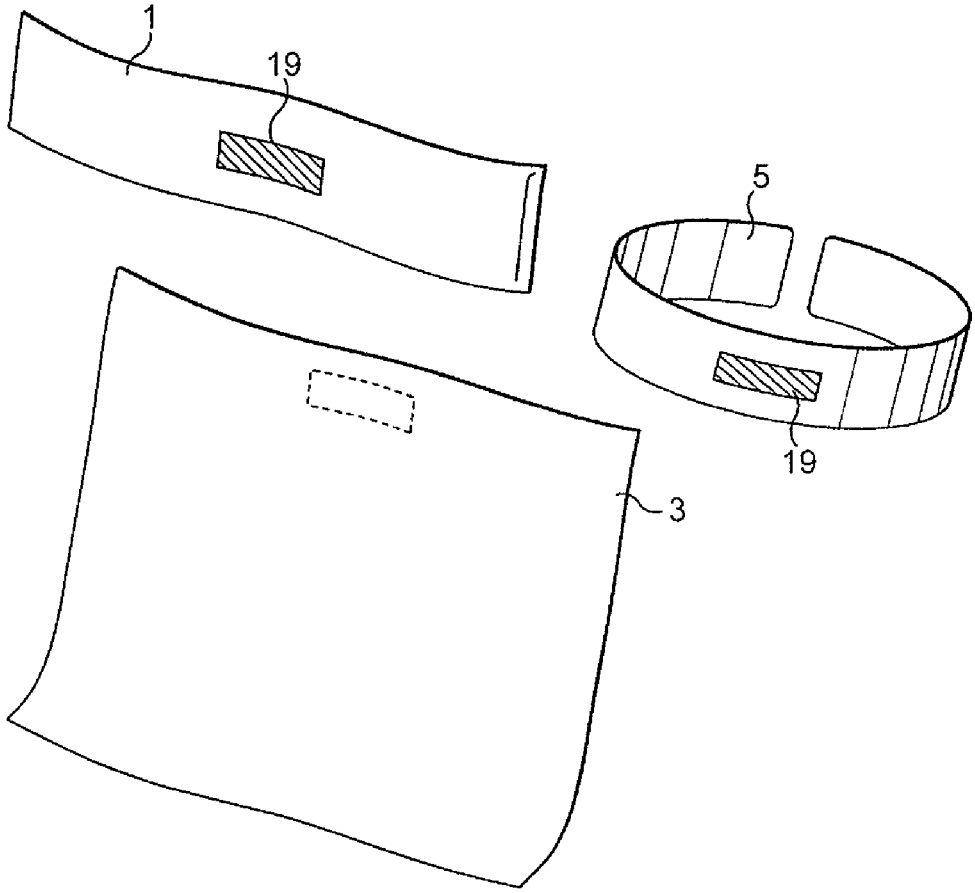
FIG. 5 is a perspective view of an embodiment in which the collar and body portions of the apron are releasably attachable to one another.
Figure 6:
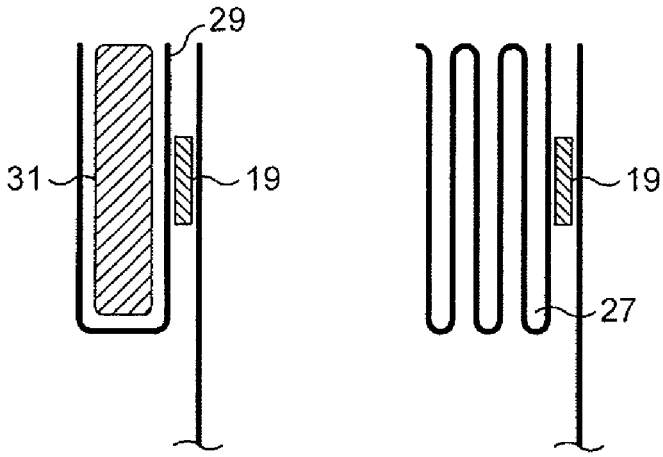
FIG. 6 is a sectional view through the collar portion showing the arrangement of the absorbing material in two further embodiments.

FIG. 5 shows a further embodiment in which the collar 5 and body portions 3 are detachable from one another using hook or loop material 19 or any other detachable securing means. Such an embodiment would allow the collar portions and the body portions to be separately replaced as they become saturated with liquid during procedures. The construction of the neck portion in this embodiment is similar to previous embodiments, and uses hook and loop material or other adhesive material to secure the collar to the neck of the patient during the procedure. FIG. 6 shows sectional views through the collar and body portions of the apron showing how the absorbing material in the collar can be formed by either a series of longitudinal pleats 27 of the collar material or by using one or more longitudinal pleats 29 with additional absorbing material 31 placed inside the pleat or pleats 29. Once again, any known fixing means can be used to secure the collar portion in position for example by using adhesive, self adhesive materials attached in between the pleats or by using stitching or other fixing means.

In a further embodiment the apron can be manufactured out of a material that changes its colour, for example from transparent or white to blue when saturated with liquid. Such an embodiment would be a useful visual indicator that would allow the dentist or his assistant to change the apron as necessary during lengthy procedures.

In a further embodiment it envisaged that the collar portion of the apron could be used on its own without the detachable main body portion. Such an embodiment would be useful for simple procedures where there is a minimal amount of liquid spill down the patient's neck, or could be used in conjunction with conventional aprons to improve their effectiveness.

Preferably both the collar and body portions are disposable.

The present invention is described with reference to an apron for use by a dentist, but those skilled in the art will appreciate the applicability of the invention for other medical and non-medical uses. For example, it could advantageously be used by hair stylists for protection of their client during the washing, cutting, dying or bleaching stages of hair treatment. Use of the present invention during the cutting stage would overcome a common problem that arises if a conventional apron is used; namely that pieces of cut hair often pass between the apron and the neck of the client, resulting in the client needing to wash the area to remove the hair trimmings and also to launder their clothes to remove hair trimmings from them. The apron as herein described for use by a hair stylist would also preferably be made out of a highly absorbent material such as towelling material, so that after the washing stage the apron would absorb any excess water that drips off the client's hair. Moreover it is appreciated that if the apron were large enough, it could even be used as a combined apron and hair-drying towel.

Furthermore it should be noted that the applicability of the invention should not be limited to being an apron for use around a patient's or client's neck; there may be other procedures where the apron could be advantageously positioned around another limb or part of the body to protect the area beneath during the procedure.

Figure 7:
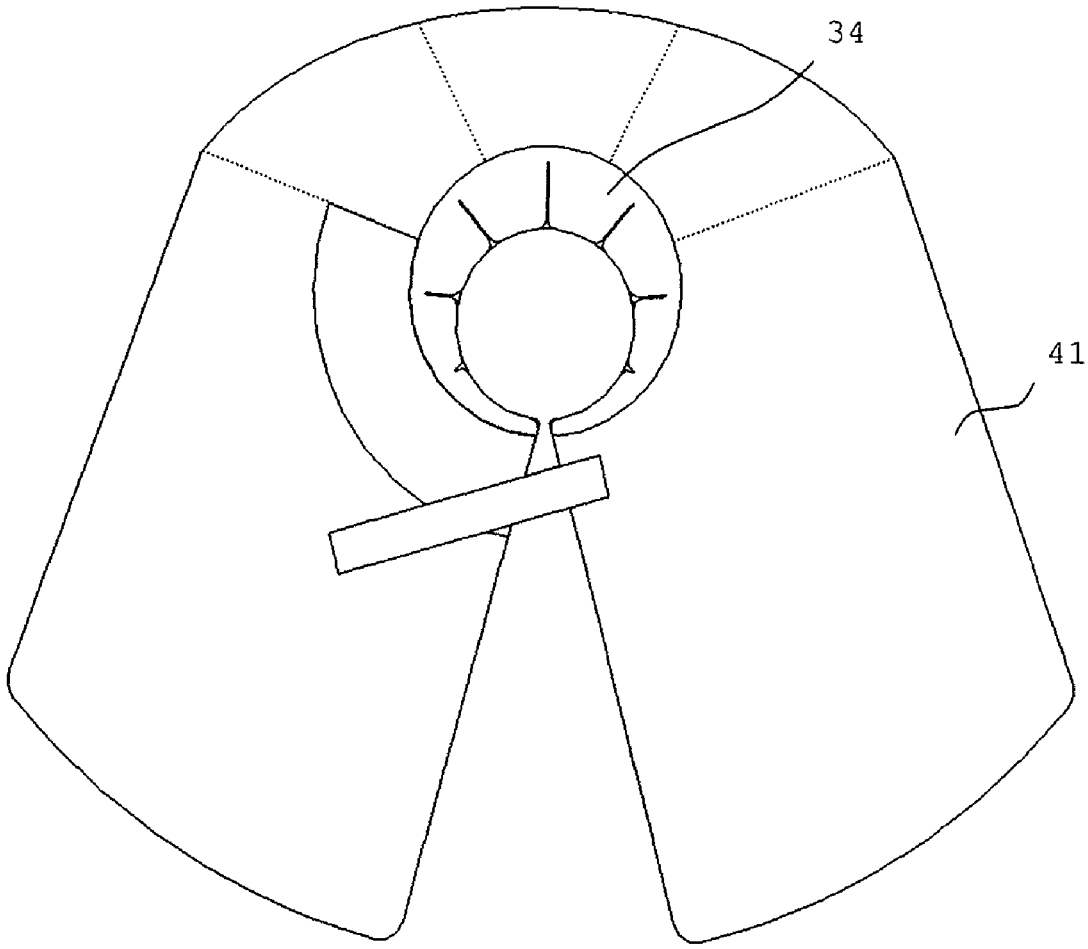
FIG. 7 is a perspective view of a further embodiment in which the collar portion comprises a series of petals.
Figure 8:
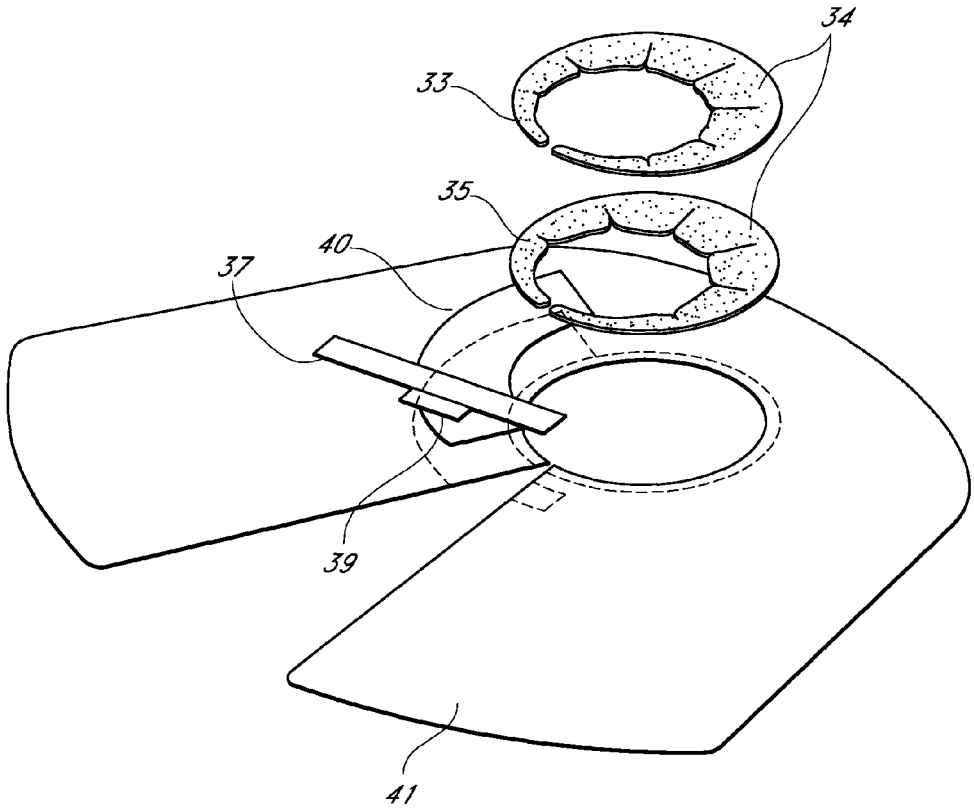
FIG. 8 is a plan view of the embodiment of FIG. 7.

FIGS. 7 and 8 show a further embodiment in which the collar portion further comprises a series of "petals" or "flaps" 34. The petal structure of the collar allows the collar to be close fitting around the neck of a wearer while being adjustable to accommodate a variety of neck sizes. The petal structure can be made out of absorbent material.

The protective apron preferably comprises a body portion of absorbent material, for example a DriFresh material. DriFresh is a liquid-absorbing, non-woven material which can be made out of cellulose. Preferably a non-woven material with an absorbency of 6000 $mlm^{-2}$ is used. One or more petal collar sections 33, 35 are attached as upper or/and lower collars. These sections are attached to the main body portion 41 either on the upper side of the absorbent material or the lower side of the absorbent material, or both. The collar portions may be attached to the body portion using any known fixing technique, for example by using one or more of the following techniques: stitching, gluing, or attached by heat sensitive adhesive.

The collar portion comprises one or more approximately trapezium-shaped petals 34. The trapezium-shaped petals fold up against the neck of the wearer when the apron is in use so that the collar forms a close fit around the neck of the wearer. In this configuration, the petals lie flat on the neck of the wearer and provide greater protection on the neck, preventing material from passing between the neck and the protective apron. If the collar petal portions are made out of liquid absorbing materials, then the petals will provide extra absorbency in the neck area. The petal structure is highly advantageous when the apron is manufactured comprising non-woven materials. These materials are relatively rigid, and so it can be difficult for the collar to fit closely around the neck of the wearer. By providing a series of petals 34, the collar portion is close fitting to the neck of the wearer for both large and small neck sizes.

Preferably a lower collar 35 is also attached using any known fixing method, in addition to an upper collar 33. The petals on the lower collar 35 are orientated such that when the petals of the upper 33 and lower collars 35 are folded flat against the neck of the wearer, any gap between the petals on the upper collar 33 is covered by a corresponding central section of the petal on the lower collar 35 and vice versa. This system of offset petals on the upper 33 and lower 35 collars provides a continuous band of preferably absorbent material around the neck of the wearer therefore preventing material from passing between the apron and the neck of the wearer.

This embodiment also has the advantage that the constituent components of the apron, that is the body portion, upper and lower collars can easily, cheaply and quickly be manufactured using die cutting techniques from sheet material and easily assembled together using known joining techniques. The shape of the apron is formed by providing creases in the apron so that the apron naturally folds flat for packaging but can easily be unfolded to form a three dimensional apron structure.

In this embodiment, the apron adjusted to the desired neck size by hook and loop material 39, 40. The hook material is attached by any known means to one side of the apron, and the loop material is attached by any known means, for example adhesive or stitching to the other side of the apron. The hook and loop material allows the apron to be attached, removed or repositioned many times without damaging the apron. This arrangement also allows the neck size of the apron to be adjusted from a maximum neck size in which the petals are next to one another to a minimum neck size in which the petals overlap one another, and provide additional absorbency at the overlapping areas.

Preferably, an elastic strip 37 is used to connect the hook fastener 39 on one side of the apron to the loop fastener 40 on the other side of the apron. This has the advantage that the neck size of the apron can be adjusted so that it is close fitting to the neck of the wearer whilst still being comfortable for the wearer. This is because the elastic strip allows the neck size of the apron to adjust to increases or decreases in the neck size of the wearer when in use so that it can expand and contract to maintain a close but comfortable fit around the neck of the wearer. Preferably the elastic strip is made out of Aplix® EFT HC material. (Aplix is a registered trade mark of Aplix (France), 75 Bis Avenue Marceau, 75116 Paris, France). This is tri-laminated with a polyolefine non-woven material with elastic material, and has a white colour. This elastic strip configuration can be used with any of the other embodiments herein described.

Figure 9:
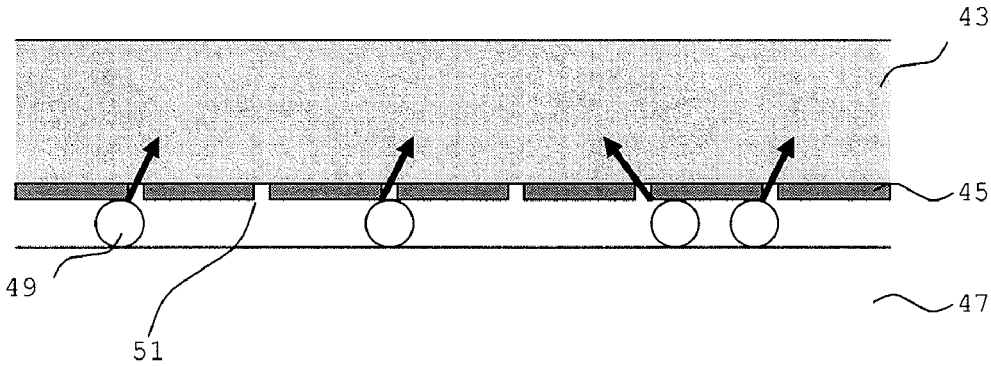
FIG. 9 is a sectional view through the collar of the apron.

Preferably, the body section 41 or and the collar portion of the apron further comprises a second layer of liquid proof material 45 laminated to the absorbent material 43. This is shown in FIG. 9. By laminated, we mean that the two materials are attached to each other using any known fixing means. FIG. 9 shows a cross section through the body section 41 of the apron. The liquid proof material 45 could be a waterproof laminated polyethylene sheet, but however any liquid proof material could be used. The advantage of using polyethylene sheet is that it can be relatively thin, for example 0.035 mm thick and of a white colour.

Preferably, the collar material also includes a liquid proof material 45 or backing material. This could comprise a water permeable laminated polyethylene sheet 45. The water permeable material can comprise liquid proof polyethylene sheet 45 with micro pores 51 in it to allow liquid 49 to pass through it. The collar material is orientated such that the liquid permeable polyethylene backing is against the neck of the wearer and the exposed fibres of the absorbent layer face outwards. This configuration allows any liquid that is between the collar and the neck to be absorbed through the micro pores in the polyethylene backing by the absorbent fibres 43, and to be trapped there in the absorbent layer. The liquid 49 is therefore drawn away from the neck and does not pass back through the micro pores 51 to rewet the neck area leaving the wearer dry and comfortable. It will be clear to those skilled in the art that the laminated collar or and neck structure can be used in conjunction with any of the embodiments herein described.

In a further embodiment, exothermic chemicals can be incorporated in the absorbent fibres which release heat when they come into contact with water. This embodiment provides additional comfort to a wearer of the apron when it gets wet during lengthy procedures because the feel the heat released from the exothermic chemicals.

In a further embodiment, tinted fibres can be used to manufacture the product. The use of tinted fibres facilitates manufacture of the apron and allows different areas of the apron to be differently coloured without the need for separately printing onto the apron.

In a further embodiment, the absorbent fibres and backing sheets can be manufactured comprising biodegradable materials. The use of biodegradable materials minimises the impact on the environment when the apron is disposed.

What is claimed is:

1. A protective apron comprising:

a main body portion and;

a collar portion for securing the apron to the wearer in which the collar portion comprises a first set of flaps attached to the apron that, when in use, lie substantially flat against the neck of the wearer to provide a close fit around the wearer, the collar portion further comprising a second set of flaps attached to the apron wherein the second set of flaps are offset from the first set of flaps such that the gaps between adjacent flaps on one set are arranged to be completely covered by the central portion of the flaps on the other set of flaps, the collar portion being adjustably securable at any position within a predetermined range such that it forms a close fit around the wearer.

2. An apron according to claim 1 wherein the collar portion is formed from material which changes colour when saturated with liquid.

3. An apron according to claim 1 in which the collar portion carries respective portions of self-adhesive material at its opposing ends for securing the collar portion around a patient.

4. An apron according to claim 1 in which the collar portion carries respective portions of hook and loop fastening material at its opposing ends for securing the collar portion around a patient.

5. An apron according to claim 1 in which the apron comprises viscose and polyester fibres in a single sheet or in a laminated configuration.

6. An apron according to claim 1 in which the apron comprises a disposable material.

7. An apron according to claim 1 wherein the collar and body portions comprise an absorbent side and a substantially waterproof side.

8. An apron according to claim 1 wherein the first and second set of flaps are made from separate pieces of material.

9. An apron according to claim 1 wherein, when in use, one of the two sets of flaps is further away from the neck of the wearer than the other set of flaps.

10. An apron according to claim 1 wherein at least one of the sets of flaps is made from at least one piece of material that is separate from a piece of material used to make the body portion.

11. An apron according to claim 1 wherein at least one of the sets of flaps is made of a different type of material than a type of material from which the body portion is made.

12. An apron according to claim 1 wherein each gap between adjacent flaps on one set of flaps is covered by a different flap on the other set of flaps.

13. A protective apron comprising:

a main body portion and;

a collar portion for securing the apron to the wearer in which the collar portion comprises a first set of flaps attached to the apron that, when in use, lie substantially flat against the neck of the wearer to provide a close fit around the wearer, the collar portion further comprising a second set of flaps attached to the apron wherein the second set of flaps are attached to the apron along a line substantially parallel to the first set of flaps and are offset from the first set of flaps such that the gaps between adjacent flaps on one set are arranged to be at least partially covered by the central portion of the flaps on the other set of flaps, the collar portion being adjustably securable at any position within a predetermined range such that it forms a close fit around the wearer.

14. A protective apron comprising:

a main body portion and;

a collar portion for securing the apron to the wearer in which the collar portion comprises a first set of flaps attached to the apron that, when in use, lie substantially flat against the neck of the wearer to provide a close fit around the wearer, the collar portion further comprising a second set of flaps attached to the apron wherein the second set of flaps are attached to the apron along a line substantially parallel to the first set of flaps and are offset from the first set of flaps such that the gaps between adjacent flaps on one set are arranged to be at least partially covered by the central portion of the flaps on the other set of flaps, the collar portion being adjustably securable at any position within a predetermined range such that it forms a close fit around the wearer, wherein the collar and body portions comprise an absorbent side and a substantially waterproof side.

* * * * *